US008978995B2

(12) United States Patent
Warwick et al.

(10) Patent No.: US 8,978,995 B2
(45) Date of Patent: Mar. 17, 2015

(54) TRACKBED LINER AND RELATED METHODS

(75) Inventors: Robert Graham Warwick, Knaresbrough Yorkshire (GB); Andrew David Leech, Dewsbury Yorkshire (GB)

(73) Assignee: Geofabrics Limited, Yorkshire (GB)

( * ) Notice: Subject to any disclaimer, the term of this patent is extended or adjusted under 35 U.S.C. 154(b) by 290 days.

(21) Appl. No.: 13/265,175

(22) PCT Filed: May 13, 2010 (Under 37 CFR 1.47)

(86) PCT No.: PCT/GB2010/050779

§ 371 (c)(1), (2), (4) Date: May 4, 2012

(87) PCT Pub. No.: WO2010/131041

PCT Pub. Date: Nov. 18, 2010

(65) Prior Publication Data

US 2012/0248214 A1 Oct. 4, 2012

(30) Foreign Application Priority Data

May 14, 2009 (GB) ..... 0908280.1

(51) Int. Cl.
*E01B 1/00* (2006.01)

(52) U.S. Cl.
CPC ..... *E01B 1/001* (2013.01); *E01B 1/008* (2013.01); *E01B 2204/05* (2013.01)
USPC ..... 238/2

(58) Field of Classification Search
CPC ..... E01B 1/00; E01B 1/001; E01B 4/008; E01B 27/00; E01B 27/02; E01B 27/021; E01B 27/04; E01B 1/008; E01B 2204/05; E01B 2204/07; E01F 5/00
USPC ..... 238/2; 405/115
See application file for complete search history.

(56) References Cited

U.S. PATENT DOCUMENTS

2005/0158123 A1 7/2005 Ianniello et al.

FOREIGN PATENT DOCUMENTS

| | | | |
|---|---|---|---|
| EP | 0492942 | A2 | 7/1992 |
| EP | 0570215 | A2 | 11/1993 |
| EP | 1619305 | A2 | 1/2006 |
| GB | 1403944 | | 8/1975 |
| GB | 2243108 | A | 10/1991 |
| GB | 2286004 | A | 8/1995 |
| GB | 2 356 880 | A | 6/2001 |

(Continued)

*Primary Examiner* — Mark Le
(74) *Attorney, Agent, or Firm* — Kirton McConkie; Evan R. Witt

(57) ABSTRACT

A trackbed liner which has a particular utility in a railway trackbed, as well as in other trackbeds such as tram trackbeds. The trackbed liner may include an upper support layer; a lower support layer; and at least one middle filtration layer of a material having a plurality of pores and which is normally impermeable to liquid water. In use and under the load of a vehicle acting on the trackbed, the filtration layer permits passage of liquid water upwardly therethrough but restricts the passage of solids materials, so as to restrict pumping erosion of material located beneath the liner. The trackbed liner may be used to renovate a trackbed comprising ballast contaminated with clay particles. The method includes removing contaminated ballast; laying the trackbed liner; and locating fresh ballast on an upper surface of the liner to provide a renovated trackbed.

22 Claims, 6 Drawing Sheets

(56) References Cited

FOREIGN PATENT DOCUMENTS

| | | | |
|---|---|---|---|
| JP | 2-61201 | * | 3/1990 |
| WO | 95/04190 A1 | | 2/1995 |
| WO | 97/36059 A1 | | 10/1997 |
| WO | 2007/090901 A1 | | 8/2007 |
| WO | 2007/099353 A1 | | 9/2007 |
| WO | 2008/009882 A2 | | 1/2008 |

* cited by examiner

TRACKBED LINER AND RELATED METHODS

BACKGROUND OF THE INVENTION

The present invention relates to a trackbed liner. In particular, but not exclusively, the present invention relates to a trackbed liner having a filtration layer which restricts the passage of solids materials through the liner. The present invention also relates to a method of manufacturing such a trackbed liner, and to methods of renovating a trackbed, of laying a track, and of displacing water from a trackbed utilising such a trackbed liner.

In the field of railway track construction, a railway is formed by constructing a foundation known as a trackbed on to which a railway track is laid. The trackbed typically comprises a 300 to 500 mm depth layer of ballast of a graded, crushed rock aggregate. The ballast is laid on a naturally occurring soil formation known as a subgrade in the region where the railway is to be constructed. As is well known, in areas where the subgrade is clay, or of a soil having a high clay content, a problem known as "pumping erosion" can occur. Pumping erosion is where, under the load of a passing train, naturally occurring groundwater is urged out of the subgrade and into the ballast. The groundwater carries fine clay particles which are deposited in the ballast and, over time, this causes a significant erosion of the subgrade, leading to settlement of the track. Additionally, migration of clay particles into the ballast has the effect of reducing friction between the aggregate materials in the ballast layer. This can result in sleepers on which rails of the track are laid settling into the ballast.

Pumping erosion is a particular problem in the railway industry due to the large, high frequency cyclical loads imparted on the trackbed during passage of a fast-moving train along the track. These loads are transmitted from the train wheels down through rails and sleepers forming the track and into the ballast, and thus to the subgrade. Also, passage of the train along the tracks can create a wave which travels along the trackbed, enhancing the pumping erosion effect.

Traditionally, this problem has been addressed by providing a layer (typically 100 to 150 mm deep) of sand on the subgrade beneath the ballast. The sand acts as a natural filter, slowing passage of water between the subgrade and the ballast, but trapping fine clay particles. Whilst this has been found to be an effective solution to the problem, the additional bulk material, transportation and labour costs involved add significantly to the overall construction cost. It is therefore generally desired to provide an alternative solution to the problem of pumping erosion.

In recent years, attempts have been made to find a textile-based solution to the problem. International patent application number PCT/GB2007/002502 (published as WO-2008/009882) to WTB Group Limited and Terram Limited discloses a containment structure comprising an open-cell matrix, and an intermediary composite comprising particulate material retained in a support matrix. The particulate material is typically sand. However, the proposed solution does not fully address the problem, and the containment structure remains bulky and heavy and thus expensive to store, transport and install. Additionally, large volumes of sand are still employed, with associated bulk material costs, and the manufacturing process, involving charging of the sand into an open-cell matrix of the containment structure, is not straightforward.

It will be understood that similar problems may occur in other, related industries such as in tramway track construction.

It is amongst the objects of embodiments of the present invention to obviate or mitigate at least one of foregoing disadvantages.

BRIEF SUMMARY OF THE INVENTION

According to a first aspect of the present invention, there is provided a trackbed liner comprising:

an upper support layer;

a lower support layer; and at least one filtration layer of a material having a plurality of pores and which is normally impermeable to liquid water, the filtration layer located between the upper and lower support layers;

wherein, in use and under load of a vehicle acting on the trackbed, the filtration layer permits passage of liquid water upwardly therethrough but restricts the passage of solids materials, so as to restrict pumping erosion of material located beneath the liner.

The material located beneath the liner will typically be a subgrade material, which will be a prepared, naturally occurring material in the region in which a track is to be laid.

Reference is made herein to the at least one filtration layer being of a material which is normally impermeable to liquid water, which should be taken to mean that the material is impermeable to liquid water in the absence of the load of a vehicle acting on the trackbed. Accordingly, it will be understood that the pressure applied to the trackbed liner by the vehicle is sufficient to cause the filtration layer to permit passage of liquid water upwardly therethrough. However, the pores of the filtration layer will be dimensioned so as to restrict the passage of solids materials even under the applied pressure of the vehicle. It will therefore be understood that the load of ballast, sleepers and track located on the liner will generally not be sufficient to cause liquid water to pass through the filtration layer; in other words, the pressure exerted upon the trackbed liner by the ballast, sleepers and track is not sufficiently high to cause liquid water to pass through the filtration layer. This offers the advantage that, once the vehicle has passed (and thus the load exerted upon the liner by the vehicle has been removed), any water which has passed upwardly through the filtration layer cannot return back down through the filtration layer. The water instead flows naturally along an upper surface of the filtration layer (laterally and/or longitudinally of the track), and/or is forced out of the trackbed by subsequent applications of pressure from successive wheels of a vehicle, and/or from a separate vehicle passing along the tracks. Furthermore, this offers the advantage that the volume of liquid water, due to natural rainfall, passing down into the subgrade is restricted as it cannot pass down through the filtration layer.

Reference is also made herein to the filtration layer restricting the passage of solids materials. It will be understood that the filtration layer may substantially prevent passage of any solids materials, or at least may restrict passage of solids materials to those having a size which is sufficiently small so as not to lead to any significant pumping erosion of the subgrade.

The at least one filtration layer may be normally vapour permeable. The pores may have a maximum dimension which is no more than about 2 μm ($2\times10^{-6}$ m), may be no more than about 1 μm ($1\times10^{-6}$ m), and may be no more than about 0.5 μm. Pores having a maximum dimension of up to 2 μm may be sufficient to prevent or at least substantially restrict passage of clay solids particles (or at least a majority of such particles), which are typically considered to have an average size of up to around 2 μm. By way of comparison, standard known water permeable geotextiles typically have pores of around 65 microns (μm) in size. The at least one filtration layer may be microporous and may have pores having a maximum dimension which is less than or equal to around 2 nm ($2\times10^{-9}$ m). The maximum dimension may be a width dimension. The maximum dimension may be a diameter. The pores may be quadrilateral in shape and may be substantially square, or may be generally circular. The at least one filtration layer may be a membrane, or film, and may be a microporous membrane. The at least one filtration layer may comprise a non-woven material, a woven material or a combination thereof. Where the at least one filtration layer comprises a woven material, the pores may be substantially square. The at least one filtration layer may be of a polymeric material. The at least one filtration layer may be of a material which is vapour permeable and normally liquid water impermeable such as that commercially available from RKW under the APTRA Trade Mark (and in particular the APTRA UV8 microporous polypropylene film), which may be a film of the type disclosed in European patent publication no. EP-0492942 to Amoco Corporation. Other materials include those commercially available from Exxon Corporation under the EXXAIRE Trade Mark, and/or from WL Gore & Associates under the GORE-TEX Trade Mark, although it will be understood that other vapour permeable/normally liquid water impermeable materials/membranes may be utilised.

The at least one filtration layer may be provided as part of a composite having upper and lower support sheets, the filtration layer located between the upper and lower support sheets. The composite may be located between the upper and lower support layers of the liner. The upper and lower support sheets may be liquid water permeable, which may be due to the material forming the support sheets being liquid water permeable. This may facilitate passage of water through the respective sheet to the filtration layer. The upper and lower support sheets may be of a polypropylene material, and may be of a spun-bonded polypropylene material. The upper and lower support sheets may be point bonded to the filtration layer. This may securely bond the upper and lower support sheets to the filtration layer whilst preserving substantially the permeability/vapour transmission properties of the filtration layer. A composite comprising such upper and lower support sheets and an EXXAIRE filtration layer is disclosed in European patent publication number 0570215A2 to Don & Low (Holdings) Limited and is commercially available from Don & Low in the United Kingdom under the ROOF TX Trade Mark.

The liner may comprise a plurality of filtration layers, each of which may be provided as part of a respective composite. The liner may comprise at least one intermediate support layer. The liner may comprise the upper support layer, an upper filtration layer, an intermediate support layer, a lower filtration layer, and a lower support layer. If desired, the liner may comprise further filtration layers and intermediate support layers.

The liner may comprise at least one drainage layer for facilitating drainage of fluids from an upper surface of the at least one filtration layer. Where there are a plurality of filtration layers, there may be a drainage layer associated with each filtration layer. The at least one drainage layer may be or may comprise an open cell structure comprising a plurality of first elongate cell elements such as wires disposed parallel to one another and in a first plane, and a plurality of second elongate cell elements such as wires disposed parallel to one another and in a second plane, the second cell elements oriented transverse (typically 90°) to the first cell elements. The first and second cell elements may be bonded together. The transverse arrangement of the first and second cell elements may provide fluid flow channels or paths within the drainage layer. The at least one drainage layer may comprise a plurality of intermediate elongate cell elements disposed parallel to one another and in a third plane, and oriented transverse to both the first and second cell elements. Alternatively, the at least one drainage layer may be or may comprise a band drain having a plurality of corrugated drainage channels, or a cuspate type drain. The at least one drainage layer may be arranged so as to drain water from the liner, in use, laterally of the liner (that is, in a direction lateral to a main extent of the liner), but may additionally or alternatively be arranged to drain longitudinally of the liner, for example, towards a lateral drainage channel.

The liner may comprise a ballast restraining layer provided uppermost of the liner, and which may serve, in use, for restraining movement of ballast along an upper surface of the liner. This may improve stability of a trackbed incorporating the liner. The restraining layer may be a mesh or mesh-type structure comprising a plurality of apertures, and may be a geogrid. Typically, the apertures will be square, but other shapes may be employed, and the apertures may have dimensions in the range of at least about 20 mm to at least about 70 mm. The dimensions of the apertures may depend upon factors including the average size of the aggregate to be used in the ballast. The restraining layer may be bonded to the upper support layer.

The upper and lower support layers may be bonded to the at least one filtration layer. Where the liner comprises a plurality of filtration layers, the upper support layer may be bonded to an upper filtration layer and the lower support layer to a lower filtration layer. The upper and lower support layers may be thermally (for example, flame or heat) bonded and/or bonded using an adhesive. Where flame/heat bonded, only the upper and lower support layers may be exposed to the flame/heat to ensure that the filtration layer is not damaged, and the respective support layer then introduced to the filtration layer. Where adhesive bonded, elongate adhesive ribs may be applied to the upper and lower support layers, for example, using an assembly comprising an adhesive supply roller and a toothed doctor blade having corrugations of a depth suitable for forming adhesive ribs of desired height on the upper and lower support layers. Alternatively, the upper and lower support layers and the filtration layer may not be bonded, and may be loose laid, in use.

The upper and lower support layers may be water permeable, and may be geotextiles. The upper and lower support layers may be of needle punched materials, for example needle punched polypropylene geotextile materials such as those available from the present applicant under the GEOfabrics® Registered Trade Mark. The upper and/or lower support layers may have a thickness in the range of about 5 mm to about 20 mm. It will be understood that the thickness will vary according to factors included an expected loading on the liner in use, and the required depth and nature of the ballast. Optionally, the upper support layer may be thicker than the lower support layer, to account for the fact that the upper support layer may be in contact with the ballast, whereas the lower support layer may be in contact with less aggressive materials. The upper and lower support layers may be cushioning layers, and may have a high resilience, to protect the at least one filtration layer from being pierced or otherwise damaged by the ballast. The upper and lower support layers may have relatively high water permeability, which may be in the range of about 5 to about 100 $l/m^2/s$, and which typically may be around 40 $l/m^2/s$. Permeability will depend upon factors including thickness and density of the support layers.

The at least one filtration layer may be normally impermeable to liquid water, but may become permeable on application of a sufficiently high pressure to a surface of the filtration layer. The at least one filtration layer may become permeable on application of a pressure of at least about 5 $kN/m^2$, may become permeable on application of a pressure of at least about 10 $kN/m^2$, may become permeable on application of a pressure of at least about 15 $kN/m^2$, and may become permeable on application of a pressure of at least about 20 $kN/m^2$. The at least one filtration layer may become permeable on application of a pressure of in the range of about 10 $kN/m^2$ to 100 $kN/m^2$, optionally in the range of about 20 $kNm^2$ to about 100 $kN/m^2$. Permeability may depend upon factors including: the material forming the filtration layer/composite; dimensions of the filtration layer/composite including pore diameters and/or thickness. Thus the filtration layer may be arranged to become permeable at a certain applied pressure (or within a certain applied pressure range) by appropriate selection of materials and/or dimensioning of the layer/composite. However, tests conducted by the inventors have indicated that the filtration layer of suitable liners typically becomes permeable at an applied pressure of around, or just below, 10 $kN/m^2$.

Whilst the liner of the present invention has a particular utility in a railway trackbed, it will be understood that the liner has a utility in other trackbeds such as in tram trackbeds, and may have a utility in other areas of construction where pumping erosion occurs.

According to a second aspect of the present invention, there is provided a trackbed liner comprising:

an upper support layer;

a lower support layer; and at least one filtration layer of a vapour permeable and liquid impermeable material, the filtration layer located between the upper and lower support layers.

The vapour permeable material may permit the passage of water vapour but restrict the passage of liquid water. In use and under the load of a vehicle passing along the track, the load exerted upon the trackbed may be sufficiently high as to cause the transmission of water vapour through the vapour permeable material. For example, the downwardly directed load of the vehicle may exert a pressure force on the trackbed which may vaporise liquid water present in the trackbed beneath the vapour permeable material, thereby encouraging passage of water vapour upwardly through the material. Following passage of the water vapour through the vapour permeable material, the water vapour may condense, and may condense on an upper surface of the vapour permeable material and/or on or in the upper support layer and/or in trackbed material located above the upper support layer. The vapour permeable material may prevent return passage of the condensed, liquid water back down through the material. This may occur following passage of the vehicle and thus removal of the applied load. The vapour permeable material may be a porous material and may be microporous. Alternatively, the filtration layer may function, in use and under the applied load of a vehicle, in the fashion described above in relation to the first aspect of the present invention.

The liner of the second aspect of the invention may include any of the features, options or possibilities set out elsewhere in this document. For example, further features of the liner of the second aspect of the invention may be derived from or in relation to the liner of the first aspect of invention and/or are defined above.

According to a third aspect of the present invention, there is provided a method of renovating a trackbed comprising ballast contaminated with clay particles, the method comprising the steps of:

removing contaminated ballast;

following removal of contaminated ballast, laying a trackbed liner having: an upper support layer; a lower support layer; and at least one filtration layer of a material having a plurality of pores and which is normally impermeable to liquid water, the filtration layer located between the upper and lower support layers; and locating fresh ballast on an upper surface of the liner to provide a renovated trackbed;

wherein, in use and under load of a vehicle acting on the trackbed, the filtration layer of the liner permits passage of liquid water upwardly therethrough but restricts the passage of solids materials, so as to restrict pumping erosion of material located beneath the liner.

According to a fourth aspect of the present invention, there is provided a method of renovating a trackbed comprising ballast contaminated with clay particles, the method comprising the steps of:

removing contaminated ballast;

following removal of contaminated ballast, laying a trackbed liner having: an upper support layer; a lower support layer; and at least one filtration layer of a vapour permeable and liquid impermeable material, the filtration layer located between the upper and lower support layers; and locating fresh ballast on an upper surface of the liner to provide a renovated trackbed.

The clay particles will typically have migrated into the ballast due to pumping erosion.

The method may comprise supporting a portion of a track located on the ballast. Following removal of the contaminated ballast, the method may comprise releasing the supported portion of track. This may apply in particular to a track comprising continuous length welded rails. The step of supporting the track may comprise exerting an upwardly directed force on the track to bend the track upwardly/stress the track such that, following release, a restoring force urges the track downwardly to exert a compressive load on the ballast. Alternatively, the step of supporting a portion of the track may comprise cutting a portion of the track, raising the cut portion and then, following location of the fresh ballast in the trackbed, lowering the cut portion on to the fresh ballast and reconnecting the track section. It will be understood that railway tracks are typically provided with continuous welded rails, but that in certain circumstances, sections of rail may be connected with a fishplate or the like and that the method may involved releasing a section from adjacent sections and supporting the released section until such time as the fresh ballast has been located in the trackbed.

The step of removing the contaminated ballast may comprise undercutting the track. The track may be undercut using a lateral chain/belt and bucket type assembly. It will be understood that the undercutting excavation process will not typically extend down to a subgrade underneath the trackbed, which would typically be clay, as this could foul the assembly; typically, the undercutting removes only ballast and/or sand.

The method may comprise tamping/compacting the fresh ballast, which may occur prior to releasing the track. The fresh ballast may be newly supplied ballast, or the contaminated ballast may be washed clean (or substantially clean) of clay particle contaminants and reused.

The method may be repeated with an adjacent portion of the track and further as necessary to renovate a desired length of trackbed.

The step of laying the trackbed liner may comprise supplying the liner in reeled form and unreeling the liner on to the surface of the remaining trackbed material or on a subgrade (depending on the depth of undercut). Typically, the trackbed liner will be made up of a plurality of separate liner sections supplied on respective reels. Adjacent ends of liner sections may be fitted end to end/butted, or may be overlapped, and may be bonded together (for example thermally and/or using adhesive).

It will be understood that the method of the third and/or fourth aspects of the invention has applicability also in areas where ballast has not yet become contaminated and thus may be utilised in an interdictory method where it is desired to prevent contamination of ballast which may otherwise occur over time.

Whilst reference is made herein to ballast being contaminated with clay particles, it will be understood that other solids particle contaminants may occur in the ballast; typically, contaminants having dimensions of the order of 2 to 10 μm may be found in the ballast.

Further features of the liner employed in the method of the third and/or fourth aspects of the invention are defined above with respect to the first and/or second aspects of the invention.

According to a fifth aspect of the present invention, there is provided a method of laying a track comprising the steps of:

laying a trackbed liner on a subgrade, the liner having: an upper support layer; a lower support layer; and at least one filtration layer of a material having a plurality of pores and which is normally impermeable to liquid water, the filtration layer located between the upper and lower support layers;

following laying of the liner, locating ballast on an upper surface of the liner to provide a trackbed; and laying a track on the trackbed;

wherein, in use, and under load of a vehicle acting on the trackbed, the liner filtration layer permits passage of liquid water upwardly therethrough but restricts the passage of solids materials, so as to restrict pumping erosion of the subgrade.

According to a sixth aspect of the present invention, there is provided a method of laying a track comprising the steps of:

laying a trackbed liner on a subgrade, the liner having: an upper support layer; a lower support layer; and at least one filtration layer of a vapour permeable and liquid impermeable material, the filtration layer located between the upper and lower support layers;

following laying of the liner, locating ballast on an upper surface of the liner to provide a trackbed; and laying a track on the trackbed.

The method may comprise preparing a subgrade, by appropriate excavation and/or levelling, to receive the trackbed liner. The liner may be laid directly on the subgrade or on material located on the subgrade, such as ballast. Optionally, a layer of sand may be located on the subgrade and the liner located on the sand layer.

The step of laying the trackbed liner may comprise supplying the liner in reeled form and unreeling the liner on to the surface of the subgrade. Typically, the trackbed liner will be made up of a plurality of separate liner sections supplied on respective reels. Adjacent ends of liner sections may be fitted end to end/butted, or may be overlapped, and may be bonded together (for example thermally and/or using adhesive).

Further features of the liner employed in the method of the fifth and/or sixth aspects of the present invention are defined above with respect to the first and/or second aspects of the invention.

According to a seventh aspect of the present invention, there is provided a method of displacing water from a trackbed in use during passage of a vehicle along a track laid on the trackbed, the method comprising the steps of:

providing a trackbed liner above a subgrade and beneath ballast of the trackbed upon which the track is located, the liner comprising: an upper support layer; a lower support layer; and at least one filtration layer of a material having a plurality of pores and which is normally impermeable to liquid water, the filtration layer located between the upper and lower support layers;

wherein, in use and under load of a vehicle acting on the trackbed, the filtration layer permits passage of liquid water upwardly therethrough from the subgrade but restricts the passage of solids materials from the subgrade, so as to restrict pumping erosion of the subgrade.

According to an eighth aspect of the present invention, there is provided a method of displacing water from a trackbed in use during passage of a vehicle along a track laid on the trackbed, the method comprising the steps of:

providing a trackbed liner above a subgrade and beneath ballast of the trackbed upon which the track is located, the liner comprising: an upper support layer; a lower support layer; and at least one filtration layer of a vapour permeable and liquid impermeable material, the filtration layer located between the upper and lower support layers.

Following passage of the vehicle, the load on the liner may be such that liquid water impermeability is restored, thereby preventing return passage of the water through the filtration layer back to the subgrade. This therefore provides a dewatering effect, enhancing shear strength of the subgrade material.

The method may comprise directing the water which has passed upwardly through the filtration layer away from an upper surface of the filtration layer. The water may be directed laterally and/or longitudinally of the trackbed. Where directed longitudinally, transverse drains may be provided at intervals along the trackbed to collect the water.

Further features of the liner employed in the method of the seventh and/or eighth aspect of the present invention are defined above in relation to the first and/or second aspects of the invention.

According to a ninth aspect of the present invention, there is provided a method of manufacturing a trackbed liner, the method comprising the steps of:

providing upper and lower support layers;

providing at least one filtration layer, said filtration layer being of a material having a plurality of pores which are dimensioned so that the filtration layer is normally impermeable to liquid water and so that, in use and under load of a vehicle acting on a trackbed containing the liner, the filtration layer permits passage of liquid water upwardly therethrough but restricts the passage of solids materials, so as to restrict pumping erosion of material located beneath the liner; and locating said filtration layer between the upper and lower support layers.

According to a tenth aspect of the present invention, there is provided a method of manufacturing a trackbed liner, the method comprising the steps of:

providing upper and lower support layers;

providing at least one filtration layer, said filtration layer being of a vapour permeable and liquid impermeable material, the filtration layer permitting passage of water vapour upwardly therethrough but restricting the passage of solids materials, so as to restrict pumping erosion of material located beneath the liner; and locating said filtration layer between the upper and lower support layers.

The method may comprise the step of bonding the upper and lower support layers to the filtration layer. The method may comprise locating a plurality of filtration layers between the upper and lower support layers, and may comprise locating an intermediate support layer between filtration layers. One of the filtration layers may be an upper filtration layer and another a lower filtration layer. The upper support layer may be bonded to the upper filtration layer and the lower support layer to the lower filtration layer. The layers may be thermally bonded such as by flame or applied heat, and/or may be bonded using an adhesive.

According to an eleventh aspect of the present invention, there is provided a trackbed liner comprising:

an upper support layer;

a lower support layer; and at least one filtration layer located between the upper and lower support layers;

wherein the at least one filtration layer is of a material having a plurality of pores which are dimensioned so as to restrict the passage of liquid water at a pressure of the liquid water below a threshold pressure, and to permit passage of liquid water at a pressure above the threshold pressure;

and wherein the at least one filtration layer restricts the passage of solids materials, so as to restrict pumping erosion of material located beneath the liner.

The at least one filtration layer may be of a material having a plurality of pores which are dimensioned so as to restrict the passage of liquid water at a pressure below a threshold pressure which may be at least about 5 $kN/m^2$, may be at least about 10 $kN/m^2$, may be at least about 15 $kN/m^2$, and which may be at least about 20 $kN/m^2$. The at least one filtration layer may be of a material having a plurality of pores which are dimensioned so as to restrict the passage of liquid water at a pressure below a threshold pressure in a range of about 10 $kN/m^2$ to 100 $kN/m^2$, optionally a range of about 20 $kN/m^2$ to about 100 $kN/m^2$.

Further features of the liner of the eleventh aspect of the present invention in common with the liner of the first and/or second aspect of the invention are defined above in relation to the first and/or second aspect.

BRIEF DESCRIPTION OF THE SEVERAL VIEWS OF THE DRAWINGS

Embodiments of the present invention will now be described, by way of example only, with reference to the accompanying drawings, in which.

DETAILED DESCRIPTION OF THE INVENTION

Figure 1:
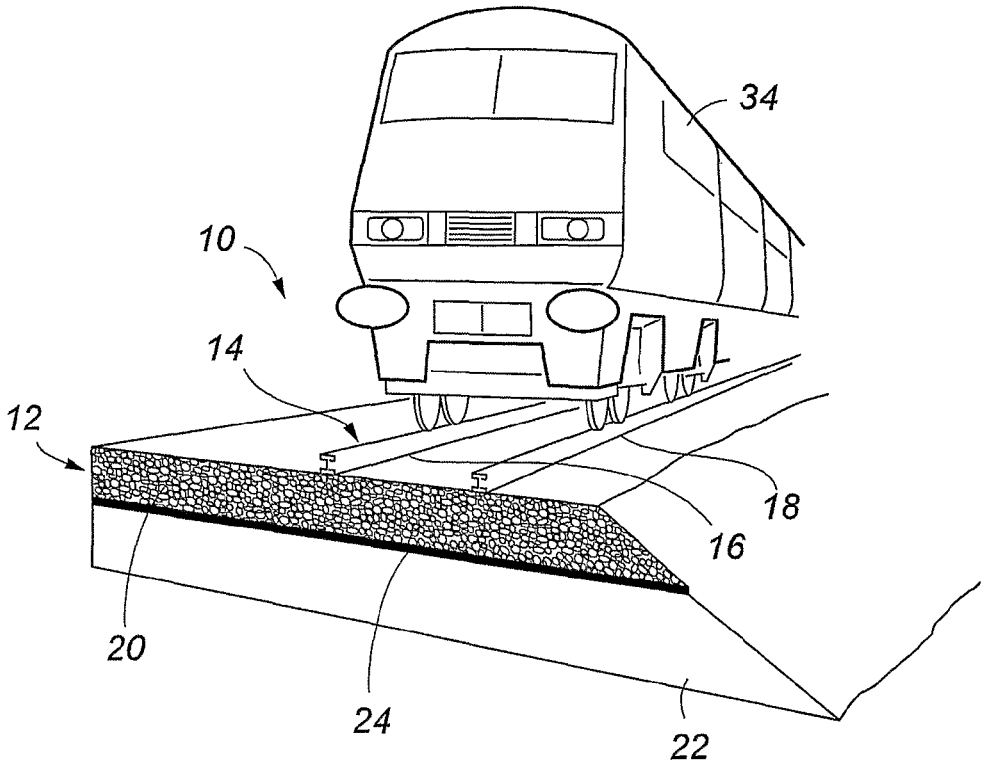
FIG. 1 is a schematic, perspective view of a railway comprising a trackbed and a track, the trackbed shown in transverse cross-section and comprising a trackbed liner in accordance with an embodiment of the present invention, the drawing also illustrating a train running on the track.

Turning firstly to FIG. 1, there is shown a railway indicated generally by reference numeral 10. The railway 10 comprises a trackbed 12 and a track 14 comprising continuous welded metal rails 16 and 18. The trackbed 12 comprises a layer of ballast 20 in the form of a coarse (typically approximately 50 mm) aggregate which has been laid on a subgrade 22 of material naturally occurring in the region of the railway 10. In this case, the subgrade 22 comprises a thick layer of a clay. FIG. 1 also shows a trackbed liner in accordance with an embodiment of the present invention, the trackbed liner indicated generally by reference numeral 24. The liner 24 is located upon the clay subgrade 22 and the ballast 20 is located upon the liner, as best shown in the enlarged, schematic view of FIG. 2. In a conventional fashion, the rails 16 and 18 of the track 14 are located upon the ballast 20 and retained using a series of spaced sleepers (not shown in FIG. 1).

Figure 3:
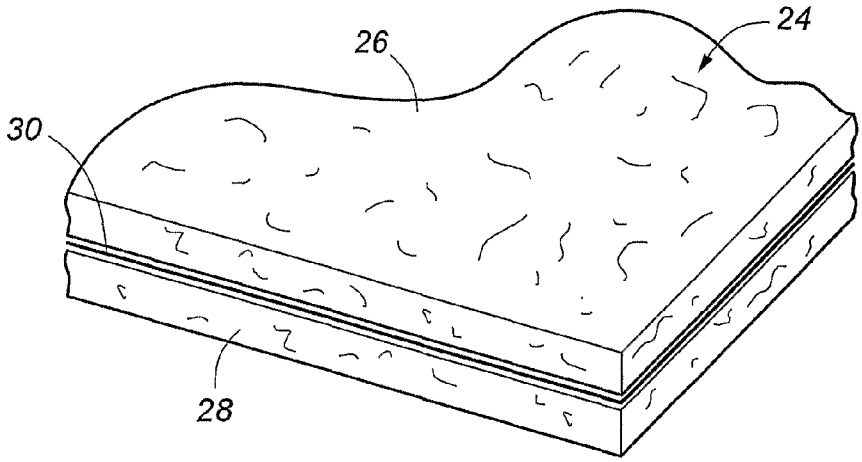
FIG. 3 is an enlarged, schematic perspective view of a portion of the liner shown in FIG. 1.

The liner 24 is shown in more detail in the enlarged, schematic perspective view of FIG. 3. The liner 24 generally comprises an upper support layer 26, a lower support layer 28 and a filtration layer 30 located between the upper and lower support layers 26 and 28. The filtration layer 30 is best shown in the further enlarged, exploded view of FIG. 4 and includes a plurality of pores, a number of which are shown and indicated generally by reference numeral 32. The filtration layer 30 may be normally impermeable to liquid water and the pores dimensioned to restrict passage of solids materials through the liner 24 from the subgrade 22 into the ballast 20. Typically, the pores 32 will be of a maximum dimension (which may be a width dimension or a diameter) of up to around 2 μm, and may have a dimension of about 2 nm. Providing pores 32 of such small dimensions restricts passage of fine clay solids from the subgrade 22 into the ballast 20. The filtration layer 30 may be vapour permeable and liquid water impermeable.

As mentioned above, the filtration layer 30 may be normally impermeable to liquid water. However, in use and under load of a vehicle acting on the trackbed 12, in this case a train 34 (FIG. 1), the filtration layer 30 permits passage of liquid water upwardly therethrough but restricts the passage of solids materials, so as to restrict pumping erosion of material located beneath the liner 24 (in this case, the clay subgrade 22). In this fashion, the trackbed liner 24 of the present invention addresses the problem of pumping erosion and without requiring a relatively thick layer of sand to be provided between the ballast 20 and the clay subgrade 22. Furthermore, the liner 24 permits passage of water from the clay subgrade 22 into the ballast 20, which occurs during passage of the train 34 along the track 14, providing a dewatering effect. Water flows from the subgrade 22 because the pressure exerted upon the liner 24 (and thus upon the filtration layer 30) as the train passes over each sleeper of the track 14 is sufficiently high to force liquid water upwardly through the pores 32 of the filtration layer 30 and into the ballast 20. However, following passage of the train 34, when the pressure acting on the filtration layer 30 reduces (and is then due only to the load exerted by the trackbed 12 and track 14), the filtration layer 30 once again becomes impermeable to liquid water. In this fashion, the liquid water which has passed upwardly through the filtration layer 30 cannot return back down through the filtration layer to the subgrade 22, and will drain from an upper surface 36 (FIG. 4) of the filtration layer 30.

The vapour permeable material of the filtration layer 30 may permit the passage of water vapour but restrict the passage of liquid water. In use and under the load of the train 34 passing along the track 14, the inventors consider that it is conceivable the load exerted upon the trackbed 12 is sufficiently high as to cause the vapourisation of liquid water and the transmission of water vapour through the vapour permeable material of the filtration layer 30. For example, the downwardly directed load of the train 34 may exert a pressure force on the trackbed 12 which vaporises liquid water present in the trackbed beneath the vapour permeable material, thereby encouraging passage of water vapour upwardly through the material. Following passage of the water vapour through the vapour permeable filtration layer 30, the water vapour may condense, and may condense on an upper surface of the vapour permeable material and/or on or in the upper support layer 24 and/or in trackbed 12 material (e.g. ballast 20) located above the upper support layer. The vapour permeable material of the filtration layer 30 may prevent return passage of the condensed, liquid water back down through the material. This may occur following passage of the train 34 and thus removal of the applied load. The vapour permeable material may be a porous material and may be microporous.

However, the inventors believe that water will be primarily or entirely transmitted through the filtration layer 30 in liquid form, the water transmission occurring due to the increased pressure exerted on the filtration layer when the train 34 passes along the track 14, as will now be described. Typical static loading on the filtration layer (due to the ballast 20 and track 14) would be less than 10 $kN/m^2$, and may be approximately 2.9 $kN/m^2$ for a typical track 14 having a 300 mm depth of ballast 20 of a density of around 1000 $kg/m^3$. The peak vertical dynamic stress during passage of the train 34 would typically be around 10 $kN/m^2$ and may be between 10 $kN/m^2$ and 100 $kN/m^2$, depending on factors including the train 34 axle load, ground stiffness and track 14 type. The filtration layer 30 may be arranged (for example by appropriate selection of materials and/or dimensioning of the material forming the layer and the pores 32) to become permeable/to vaporise water in the trackbed 12 on application of a pressure of at least about 10 $kN/m^2$, optionally about 15 $kN/m^2$, optionally about 20 $kN/m^2$, and may be arranged to become permeable/to vaporise water in the trackbed 12 on application of a pressure in the range of about 10 $kN/m^2$ to 100 $kN/m^2$. Permeability/vapour transmission may depend upon factors including: the material forming the filtration layer 30; and/or dimensions of the filtration layer including pore 32 diameters and/or thickness of the filtration layer.

Figure 2:
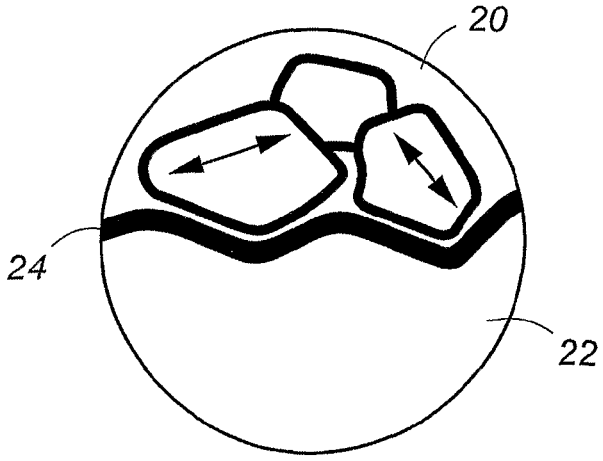
FIG. 2 is an enlarged, schematic detailed view of the trackbed of FIG. 1.

The structure of the trackbed liner 24, and its method of construction, will now be described in more detail. The upper and lower support layers 26 and 28 are typically of needle punched polypropylene Geotextile materials, such as those commercially available from the present applicant under the GEOfabrics® Registered Trade Mark. Such materials have a high resilience and provide protection for the filtration layer 30 against puncture by the ballast 20, as best shown in FIG. 2. Typically the upper and lower support layers 26 and 28 will have a thickness in the range of 5 to 20 mm, but the thickness will depend upon factors including anticipated loading to be borne by the trackbed 12 during passage of a train 34, as well as the desired depth, weight and nature of the material forming the ballast 20.

Figure 4:
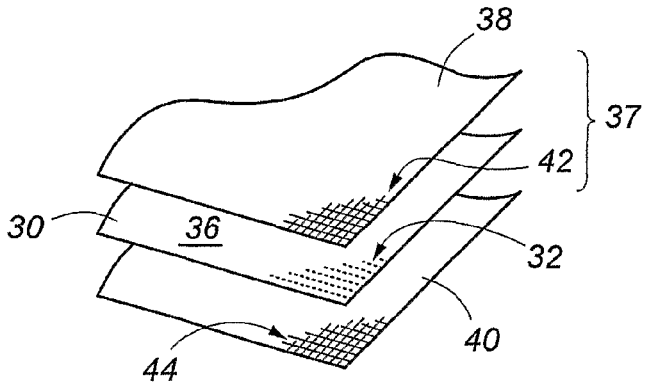
FIG. 4 is a further enlarged, exploded view of a filtration layer forming part of the liner shown in FIG. 3.

The filtration layer 30 is provided as a composite, best shown in the exploded perspective view of FIG. 4, and indicated generally by reference numeral 37. The composite comprises upper and lower support sheets 38 and 40. The support sheets 38 and 40 are bonded to the filtration layer 30 to provide a thin (typically of the order of 0.01 mm to 0.2 mm) composite sheet material. The upper and lower support sheets 38 and 40 are typically of a spun bonded polypropylene material, and the filtration layer 30 is of a vapour permeable and (normally) liquid water impermeable material, such as that available from RKW under the APTRA Trade Mark (and in particular the APTRA UV8 microporous polypropylene film), from Exxon Corporation under the EXXAIRE Trade Mark, and/or from WL Gore & Associates under the GORE-TEX Trade Mark. Generally, extruded films of the type disclosed in European patent publication no. EP-0492942 to Amoco Corporation might be suitable (and which may include APTRA materials). The filtration layer may be a woven or non-woven material. Woven materials include GORE-TEX materials and non-woven materials include APTRA and EXXAIRE materials. The particular shape of the pores 32 will depend upon factors including the process used to manufacture the material forming the filtration layer 30. For example, woven materials may have substantially square pores whilst non-woven materials may have pores which are generally circular (or non-uniform). The support sheets 38 and 40 are point bonded to the filtration layer 30 as shown at 42 and 44, so as to preserve the vapour transmission properties of the filtration layer 30. The material of the support sheets 38 and 40 is liquid water permeable. Whilst the support sheets 38, 40 and filtration layer 30 are typically provided as a bonded composite 37, they may be provided separately (and thus not bonded) and positioned between the upper and lower support layers 26 and 28.

Typically, the upper and lower support layers 26 and 28 of the liner 24 will be bonded to the composite 37. This may be achieved thermally, such as by application of a flame or heat, and/or using an adhesive. Thermal bonding will typically involve flaming/heating the upper and lower support layers 26 and 28 and then introducing them to the filtration layer 30, the various components typically guided through a set of nip rollers in a conventional fashion to bond them together. Where an adhesive is to be utilised, this will typically be supplied from a feed roller (not shown) using a corrugated doctor blade to form a set of longitudinally extending parallel ribs of adhesive, again in a conventional fashion. Whilst the components may be bonded, it is also possible that each of the upper and lower support layers 26 and 28 (and indeed the composite 37, as discussed above) can be supplied separately and freely laid on the subgrade 22. Thus the various components may not be bonded together. However, pre-bonding is preferred as the upper and lower layers 26 and 28 then provide protection for the composite 37, in particular the filtration layer 30, during transportation and handling of the liner 24.

Figure 5:
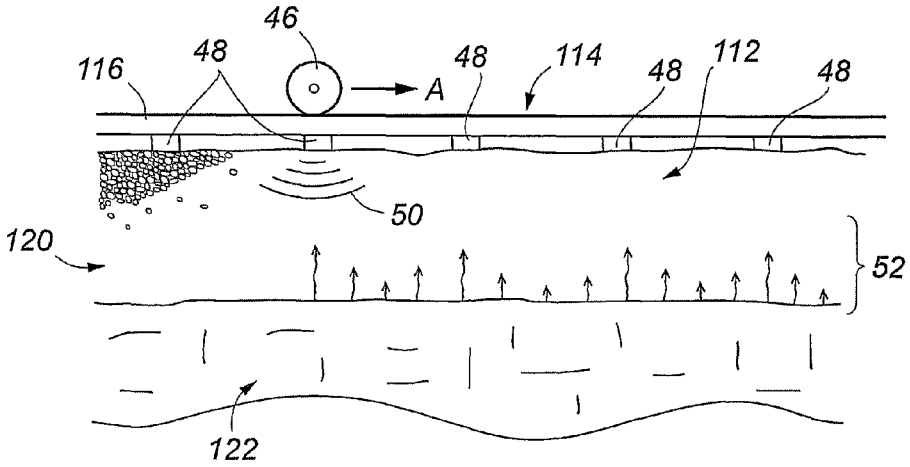
FIG. 5 is a schematic, partial longitudinal sectional view of a trackbed prior to renovation.
Figure 6:
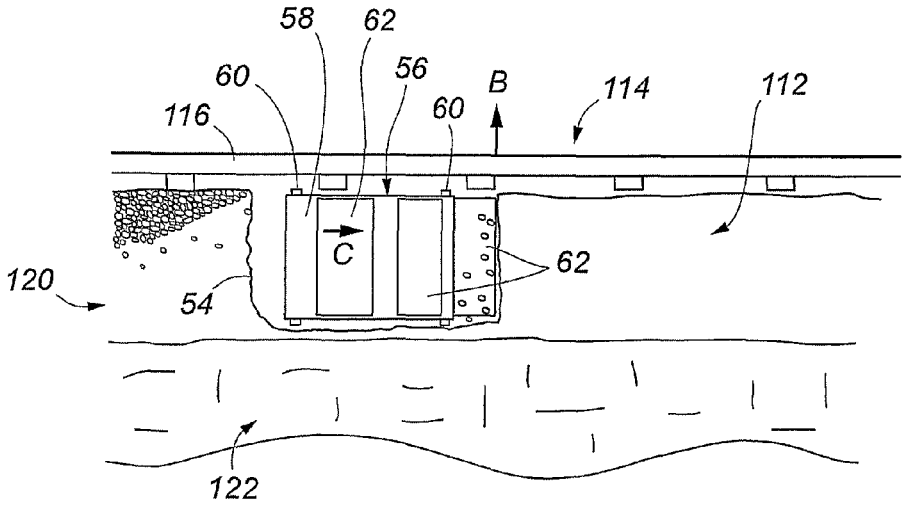
FIGS. 6, 7 and 8 are schematic, partially longitudinally sectional views illustrating steps in a method of renovating a trackbed in accordance with an embodiment of the present invention and which involves laying the trackbed liner of FIGS. 1 to 4.
Figure 7:
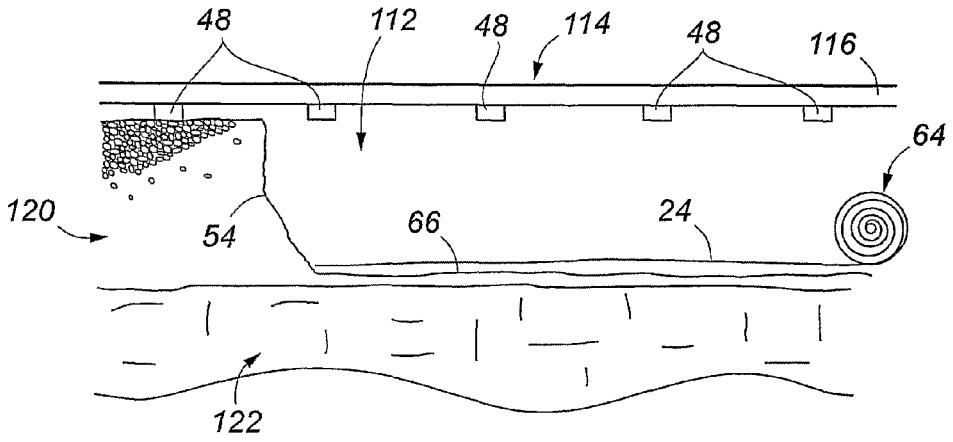
Figure 8:
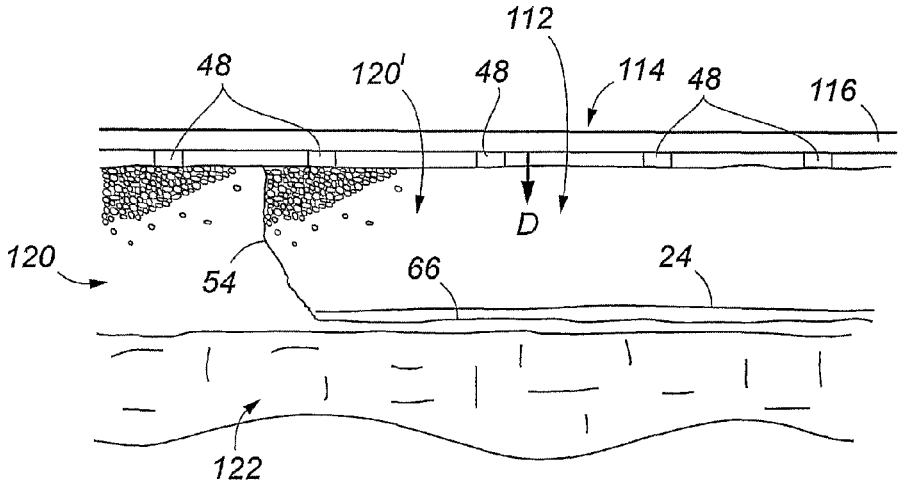

Turning now to FIG. 5, there is shown a schematic, partial longitudinal sectional view of a trackbed 112 prior to renovation. The trackbed 112 comprises a layer of ballast 120 laid on a clay subgrade 122. FIGS. 6, 7 and 8 are schematic, partial longitudinal sectional views of steps in a method of renovating the trackbed 112 in accordance with an embodiment of the present invention, and which involves laying the trackbed 24 liner of FIGS. 1 to 4. Like components with FIGS. 1 to 4 share the same reference numerals, incremented by 100. A wheel 46 of a vehicle such as the train 34 shown in FIG. 1 is illustrated passing along a track 114 on the trackbed 112, travelling in the direction of the arrow A in the Figure. Only one rail 116 of the track 114 is shown in the Figure. The track 114 is laid on a series of regularly spaced sleepers 48, in a fashion well known in the art and discussed above. As the wheel 46 travels along the rail 116, a load is transmitted down through each of the sleepers 48 in turn. The load on each sleeper 48 is transmitted into the ballast 120 and ultimately to the subgrade 122, as indicated schematically at 50. It will be understood that the loads are greatest at the point where the wheel 46 lies vertically above the sleeper 48, and that the loading on each sleeper is cyclical in that the train 34 has a large number of sets of such wheels 46 passing over each sleeper in turn. Thus a relatively high frequency (depending upon train speed) cyclical load is exerted upon each sleeper 48. In the absence of a layer of sand on the clay subgrade 122, pumping erosion of the clay subgrade occurs, with liquid water travelling upwardly as indicated by the arrows 52. The water passing upwardly from the clay subgrade 122 carries fine clay solids particles in to the ballast 120. As discussed in detail above, over time this causes settlement of the ballast 120 and thus of the track 14.

Turning now to FIG. 6, there is shown a first step in the method of renovating the trackbed 112 of FIG. 5. A maintenance vehicle (not shown) of a type known in the art is located in the area of the track 114 to be renovated. The maintenance vehicle includes a hoist arrangement which is connected to the track 114 and which is used to exert a force on the track 114 upwardly, in the direction of the arrow B in the Figure, thereby slightly raising the track and pre-stressing the rails. A small lateral trench 54 is then excavated in the ballast 120 and a transverse chain/belt and bucket type excavation assembly 56 of the maintenance vehicle is located in the trench 54. The excavation assembly 56 is again of a type known in the art, and is illustrated schematically in the Figure. The excavation assembly 56 includes a drive chain or belt mounted on drive shafts 60 and which carries a number of buckets, three of which are shown and given the reference numeral 62. The drive chain 58 extends transverse to the track 14 and is typically inclined relative to the track axis. The excavation assembly 56 is activated to drive the buckets 62 in the direction of the arrow C, and the maintenance vehicle moved slowly forward. The buckets 62 progressively excavate a portion of the ballast 120, transferring this laterally to the side of the track 114 for collection, thereby extending the trench 54.

FIG. 7 shows the trackbed 112 following excavation of a portion of the ballast 120 and during laying of the trackbed liner 24. As shown in the Figure, the liner 24 is supplied on a reel 64 which is located in the extended trench 54. The reel 64 is suspended from the maintenance vehicle and, as the vehicle moves slowly forward, deploys the liner 24 into a base 66 of the trench 54. It will be understood that a number of such reels 64 may be required to completely renovate a desired length of track 114. The reel 64 is suspended from a portion of the maintenance vehicle which is located rearwardly of the excavation assembly 56. In this fashion, following initial excavation to provide space for location of the reel 64 within the trench 54, continuous excavation and lining may be performed.

FIG. 8 shows a further step in the renovation method in which fresh ballast 120' has been supplied in to the trench 54 on to the liner 24 in the base 66 of the trench. The ballast 120' is supplied from hoppers (not shown) provided rearwardly of the reel 64, to thereby allow for progressive excavation, lining and ballast filling of the trench 54. In a known fashion, the ballast is tamped to provide a secure, stable foundation for the track 114, and the track is then released. The pre-stress in the track rails causing a downwardly directed restoring force to be exerted on the ballast 120' in the direction of the arrow D. The fresh ballast 120' charged in to the trench 54 may either be new ballast, or the old ballast 120 may be washed to remove clay solids contaminants, either on site or in a remote location, and then recharged into the trench.

It will be understood that the trackbed liner 24 may be used in the construction of a new track, when the liner 24 will be deployed directly on to the clay subgrade 22 (FIG. 1), or optionally on to a sand layer above the subgrade if this is deemed suitable or necessary. The ballast 20 will then be supplied on to the liner 24 and the track 14 assembled, in a conventional fashion.

Figure 9:
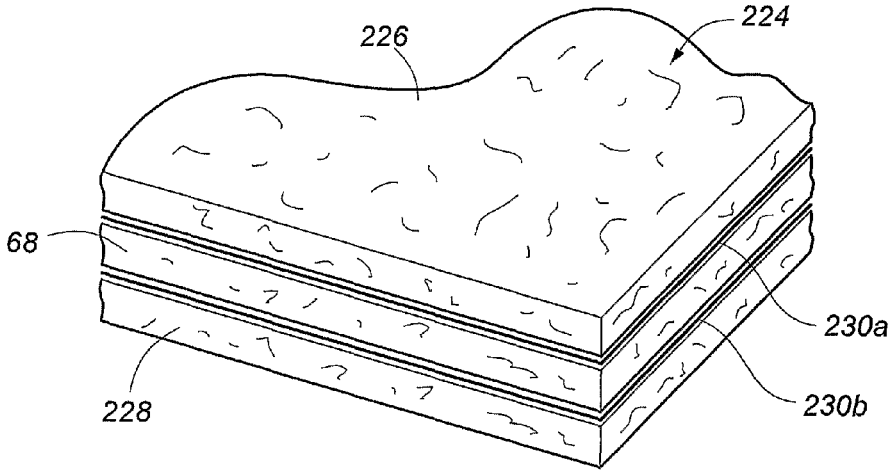
FIG. 9 is a schematic, perspective view of a portion of a trackbed liner in accordance with an alternative embodiment of the present invention.

Turning now to FIG. 9, there is shown a schematic, perspective view of a portion of a trackbed liner in accordance with an alternative embodiment of the present invention, the liner indicated generally by reference numeral 224. Like components of the liner 224 with the liner 24 of FIGS. 1 to 4 share the same reference numerals, incremented by 200.

The liner 224 includes upper and lower support layers 226 and 228, and two filtration layers 230*a*, 230*b*. Each of the filtration layers 230*a*, 230*b* are of a similar composite structure to the composite 37 shown in FIG. 4. The filtration layers 230*a*, 230*b* are separate by an intermediate support layer 68, which is of similar construction to the upper and lower support layers 226 and 228, and which is optionally bonded to both the filtration layers 230*a*, 230*b* in the manner described above. Equally however, component parts of the liner 224 may be loose laid. Provision of the two filtrations layers 230*a*, 230*b* offers enhanced pumping erosion protection, whilst the intermediate support layer 68 provides improved cushioning and thus protection for the filtration layers. It will be understood that the thicknesses of the support layers 226, 68 and 228 may be the same or may vary according to particular circumstances of use. It will also be understood that further filtration layers and intermediate support layers (not shown) may be provided.

Figure 10:
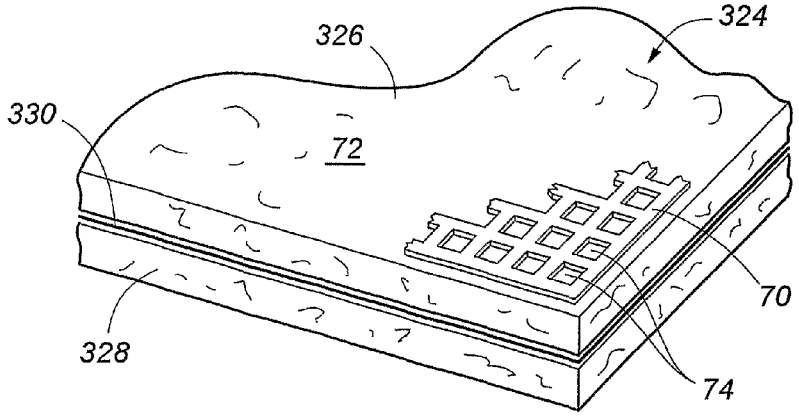
FIG. 10 is a schematic, perspective view of a portion of a trackbed liner in accordance with a further alternative embodiment of the present invention.

Turning now to FIG. 10, there is shown a schematic, perspective view of a portion of a trackbed liner in accordance with a further alternative embodiment of the present invention, the liner indicated generally by reference numeral 324. Like components of the liner 324 with the liner 24 of FIGS. 1 to 4 share the same reference numerals, incremented by 300. In a similar fashion to the liner 24, the liner 324 includes upper and lower support layers 326, 328 and a filtration layer 330. Additionally, the liner 324 includes a ballast restraining layer in the form of a geogrid 70, which is typically bonded to an upper surface 72 of the upper support layer 326. The geogrid 70 is of conventional construction and defines a number of apertures 74, which are typically approximately square in shape and have a width of between 20 to 50 mm. These apertures 74 are relatively shallow, the depth determined by the thickness of the geogrid 70 (typically between 3 to 5 mm). The apertures 74 define pockets in which the lower layer of coarse ballast material sits, to resist lateral movement of the ballast along the surface 72. This assists in stabilising the ballast charged on to the liner 324 and thus the trackbed.

Figure 11:
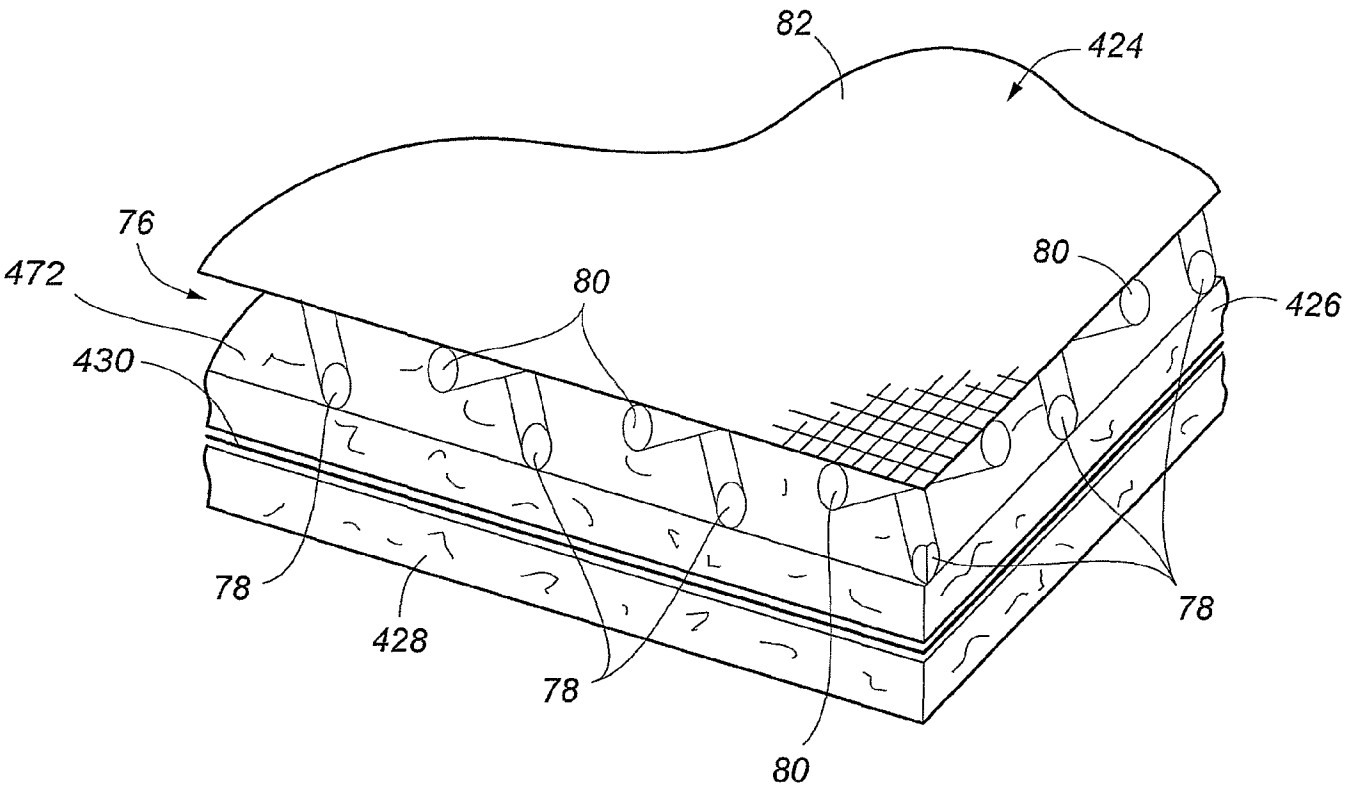
FIG. 11 is a schematic, perspective view of a portion of a trackbed liner in accordance with a still further alternative embodiment of the present invention.

Turning now to FIG. 11, there is shown a schematic perspective view of a portion of a trackbed liner in accordance with a yet further alternative embodiment of the present invention, the liner indicated generally by reference numeral 424. Like components of the liner 424 with the liner 24 of FIGS. 1 to 4 share the same reference numerals, incremented by 400. In a similar fashion to the liner 24, the liner 424 includes upper and lower support layers 426, 428 and a filtration layer 430. Additionally however, a drainage layer 76 of conventional construction is provided and is bonded to an upper surface 472 of the upper support layer 426. The drainage layer 76 is of an open-cell type structure comprising a plurality of first parallel cell elements in the form of first wires 78 and which are disposed in a first plane. Additionally, the drainage layer 76 includes a second set of parallel cell elements in the form of second wires which are disposed in a second plane and oriented transverse (typically 90°) to the first wires 78, and which are bonded to the first wires. Typically the wires 78, 80 are thermally bonded and are of a suitable plastics material such as polyethylene. A sheet 82, typically of a woven textile and which may be of a polypropylene material, may be provided and bonded to the second wires 80. The sheet 82 assists in preventing ballast aggregate from passing into and blocking drainage channels or paths defined between the first and second wires 78 and 80. If desired, a thicker upper support sheet may be provided and which may be of a material similar to that of the upper and lower support layers 426, 428. This may permit fluid flow in to the drainage layer 76 but provide enhanced protection.

Alternative drainage layers, such as band drains having a corrugated insert disposed between a pair of support sheets and which defines a number of elongate drainage channels, or a cuspate type drain (not shown), may be utilised in place of the drainage layer 76. Additionally and if desired, a drainage layer similar to the layer 76 may be provided, comprising first and second wires similar to the wires 78 and 80, but with a third set of elongate wires (not shown) disposed between the first and second wires. The third wires define a spacing between the first and second wires to provide more open drainage channels. Typically the third set of wires would extend transverse (suitably 45°) to both the first and second wires, and would define drainage channels extending in a direction parallel to the axes of the third wires. Typically these third wires would be oriented transverse to a main axis of the liner and would be laid so that the drainage paths are transverse to the track 14, thus draining fluid laterally to the sides of the track.

Various modifications may be made to the foregoing without departing from the spirit and scope of the present invention.

For example, in further alternative embodiments of the present invention, a trackbed liner may be provided having the features of one or more of the above described embodiments. For example, in a further alternative embodiment, a trackbed liner may be provided comprising both a drainage layer and a geogrid and/or with multiple filtration layers and intermediate support layers, or a trackbed liner of the type shown in FIG. 9 may be provided but including an intermediate drainage layer located between the upper and lower support sheets.

Other types of materials may be utilised, where appropriate. In particular, alternative types of "breathable" materials may be utilised for the filtration layer.

The at least one drainage layer may be arranged so as to drain water from the liner, in use, laterally of the liner (that is, in a direction lateral to a main extent of the liner), but may additionally or alternatively be arranged to drain longitudinally of the liner, for example, towards a lateral drainage channel.

The upper support layer may be thicker than the lower support layer, to account for the fact that the upper support layer may be in contact with the ballast, whereas the lower support layer will typically be in contact with less aggressive materials.

Whilst the liner of the present invention has a particular utility in a railway trackbed, it will be understood that the liner has a utility in other trackbeds such as in tram trackbeds, and may have a utility in other areas of construction where pumping erosion occurs. Such uses will include environments where a free draining (e.g. aggregate), open surface layer allows flow of naturally occurring rainwater down to a subgrade or sub-base.

Whilst the filtration layer is defined as having a plurality of pores, it will be understood that the filtration layer may comprise other suitable apertures.

Whilst the trackbed liner is shown in some of the accompanying drawings located directly on a (clay) subgrade and beneath a layer of ballast, it will be understood that the liner may be located on ballast material and thus effectively positioned within the ballast layer. A method of renovating a trackbed may therefore comprise removing contaminated ballast down to a certain level leaving ballast on the subgrade, and then laying the trackbed liner on remaining ballast. A method of laying a track may similarly comprise locating some ballast on a subgrade, then laying the trackbed liner on said ballast before locating further ballast on the liner.

The invention claimed is:

1. A trackbed liner of a railway trackbed comprising ballast and a track, the trackbed liner comprising:

an upper support layer;

a lower support layer; and at least one filtration layer located between the upper and lower support layers, the filtration layer comprising a material having a plurality of pores and which is impermeable to liquid water under a pressure load imposed on the filtration layer by the railway trackbed until it becomes permeable to liquid passing upwardly through the filtration layer upon a pressure load imposed by a vehicle of at least about 10 kN/m2 acting on the trackbed, and wherein the filtration layer restricts the passage of solids materials, so as to restrict pumping erosion of material located beneath the liner.

2. A liner as claimed in claim 1, wherein the at least one filtration layer is vapour permeable.

3. A liner as claimed in claim 1, wherein the pores have a maximum dimension of no more than about 2 μm (2×10-6 m).

4. A liner as claimed in claim 1, wherein the at least one filtration layer is microporous, having pores with a maximum dimension of less than or equal to around 2 nm (2×10-9 m).

5. A liner as claimed in claim 1, wherein the at least one filtration layer is a membrane.

6. A liner as claimed in claim 1, wherein the at least one filtration layer is of a woven material.

7. A liner as claimed in claim 1, wherein the at least one filtration layer is of a non-woven material.

8. A liner as claimed in claim 1, wherein the at least one filtration layer is provided as part of a composite having upper and lower support sheets, the filtration layer located between the upper and lower support sheets, and wherein the composite is located between the upper and lower support layers of the liner.

9. A liner as claimed in claim 1, wherein the upper and lower support sheets are liquid water permeable, to facilitate passage of water through the respective sheet to the filtration layer.

10. A liner as claimed in claim 1, comprising at least one drainage layer for facilitating drainage of fluids from above an upper surface of the at least one filtration layer.

11. A liner as claimed in claim 1, wherein the upper and lower support layers are bonded to the at least one filtration layer.

12. A liner as claimed in claim 1, wherein the upper and lower support layers are of a water permeable needle punched material.

13. A liner as claimed in claim 1, wherein the at least one filtration layer becomes permeable to liquid water on application of a pressure load imposed by the vehicle of at least about 15 kN/m2 thereon.

14. A trackbed liner of a railway trackbed comprising ballast and a track, the trackbed liner comprising:

an upper support layer;

a lower support layer; and at least one filtration layer located between the upper and lower support layers, the filtration layer comprising a material that is water vapour permeable and that is liquid water impermeable under a pressure load imposed on the filtration layer by the railway trackbed until it becomes permeable to liquid passing upwardly through the filtration layer upon a pressure;

load imposed by a vehicle of at least about 10 kN/m2 acting on the trackbed, and wherein the filtration layer restricts the passage of solids materials, so as to restrict pumping erosion of material located beneath the liner.

15. A method of renovating a trackbed comprising ballast contaminated with clay particles, the method comprising the steps of:

removing contaminated ballast;

following removal of contaminated ballast, laying a trackbed liner having: an upper support layer, a lower support layer, and at least one filtration layer located between the upper and lower support layers, the filtration layer comprising a material having a plurality of pores and which is impermeable to liquid water; and locating fresh ballast on an upper surface of the trackbed liner to provide a renovated trackbed;

wherein the trackbed liner is impermeable to liquid water under a pressure load imposed on the liner by a railway trackbed that includes a track and ballast until the trackbed liner becomes permeable to liquid passing upwardly through the filtration layer upon a pressure load imposed by a vehicle of at least about 10 kN/m2 acting on the trackbed, and wherein the filtration layer restricts the passage of solids materials, so as to restrict pumping erosion of material located beneath the liner.

16. A method as claimed in claim 15, wherein the step of removing contaminated ballast comprises undercutting the track to a depth above a subgrade on which the contaminated ballast is located.

17. A method of laying a track comprising the steps of:

laying a trackbed liner on a subgrade, wherein the liner has an upper support layer, a lower support layer, and at least one filtration layer located between the upper and lower support layers, the filtration layer comprising a material having a plurality of pores and which is impermeable to liquid water based upon a pressure load imposed upon the filtration layer;

following laying of the liner, locating ballast on an upper surface of the liner to provide a trackbed; and laying a track on the trackbed;

wherein the filtration layer is impermeable to liquid water under a pressure load imposed on the filtration layer by the trackbed until it becomes permeable to liquid water passing upwardly through the filtration layer upon a pressure load of a vehicle of at least about 10 kN/m2 acting on the trackbed, and wherein the liner filtration layer restricts the passage of solids materials, so as to restrict pumping erosion of the subgrade.

18. A method of displacing water from a trackbed in use during passage of a vehicle along a track laid on the trackbed, the method comprising the steps of:

providing a trackbed liner above a subgrade and beneath ballast of the trackbed upon which the track is located, the liner comprising: an upper support layer; a lower support layer; and at least one filtration layer located between the upper and lower support layers, the filtration layer comprising a material having a plurality of pores and which is impermeable to liquid water based upon a pressure load imposed upon the filtration layer;

wherein the filtration layer is impermeable to liquid water under a pressure load imposed on the filtration layer by the trackbed until it becomes permeable to liquid water passing upwardly through the filtration layer upon a pressure load of a vehicle of at least about 10 kN/m2 acting on the trackbed, and wherein the filtration layer restricts the passage of solids materials from the subgrade, so as to restrict pumping erosion of the subgrade.

19. A method as claimed in claim 18 wherein, following passage of the vehicle, the load on the liner is such that liquid water impermeability is restored, thereby preventing return passage of the water through the filtration layer back to the subgrade, to provide a dewatering effect.

20. A method as claimed in claim 18, comprising directing water which has passed upwardly through the filtration layer away from an upper surface of the filtration layer.

21. A method of providing a trackbed liner, the method comprising the steps of:

providing upper and lower support layers;

providing at least one filtration layer, said filtration layer being of a material having a plurality of pores which are dimensioned so that the filtration layer is impermeable to liquid water under a pressure load imposed on the filtration layer by a railway trackbed comprising a track and ballast overlying the filtration layer until it becomes permeable to liquid water passing upwardly through the filtration layer upon a pressure load of a vehicle of at least about 10 kN/m2 acting on the trackbed, and wherein the filtration layer restricts the passage of solids materials, so as to restrict pumping erosion of material located beneath the liner; and locating said filtration layer between the upper and lower support layers.

22. A method as claimed in claim 21, comprising locating a plurality of filtration layers between the upper and lower support layers.

* * * * *